United States Patent [19]

Ulics

[11] 4,289,156

[45] Sep. 15, 1981

[54] CRUTCH ATTACHMENT

[76] Inventor: George Ulics, 1300 Venice, Dearborn, Mich. 48124

[21] Appl. No.: 73,912

[22] Filed: Sep. 10, 1979

[51] Int. Cl.[3] ..... A45B 1/00; A61H 3/02

[52] U.S. Cl. ..... 135/66; 248/311.2

[58] Field of Search ..... 135/65–68; 248/312, 311.2

[56] References Cited

U.S. PATENT DOCUMENTS

| | | | |
|---|---|---|---|
| 2,745,465 | 5/1956 | Hogan | 135/67 X |
| 2,750,951 | 6/1956 | Barnwell | 135/66 X |
| 2,912,991 | 11/1959 | Shinn | 135/66 X |
| 3,429,541 | 2/1969 | Herman | 135/68 X |
| 3,957,071 | 5/1976 | Kenner | 135/66 |
| 3,985,148 | 10/1976 | Cadman | 135/66 |
| 4,074,683 | 2/1978 | Di Chiara | 135/67 |
| 4,146,045 | 3/1979 | Grant | 135/66 |

*Primary Examiner*—J. Karl Bell

*Attorney, Agent, or Firm*—Charles W. Chandler

[57] ABSTRACT

A container is suspended from the bolt that connects the handle of a crutch to the crutch side rails.

7 Claims, 10 Drawing Figures

CRUTCH ATTACHMENT

BACKGROUND OF THE INVENTION

The invention is related to crutch attachments, and more particularly to a container which depends from the bolt that is mounted on the pre-existing holes in the crutch side rails and supports the crutch handle.

Crutch users frequently desire a convenient container for carrying a variety of articles, because conventional purses and other containers, normally carried by the user, cannot be employed because it is necessary for him to use his hands in manipulating the crutches.

SUMMARY OF THE INVENTION

The broad purpose of the present invention is to provide a container that can be readily mounted on a conventional crutch without forming new holes that may tend to weaken the design strength of the crutch.

The preferred embodiment of the invention, which will be described in greater detail, comprises a one-piece high impact-resistant plastic tray having a pair of tabs spaced a distance accommodating the distance between the crutch side rails. The tabs receive the bolt that fastens the crutch handle on the side rails. The tabs also have a pair of teeth receivable in other openings in the crutch side rails to prevent the container from moving with respect to the crutch. In addition, the preferred container has a pair of internal, vertical ridges for receiving and wedging a standard beverage container in an upright position.

Another embodiment of the invention employs a retainer for hanging the container from the top rail of a walker.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
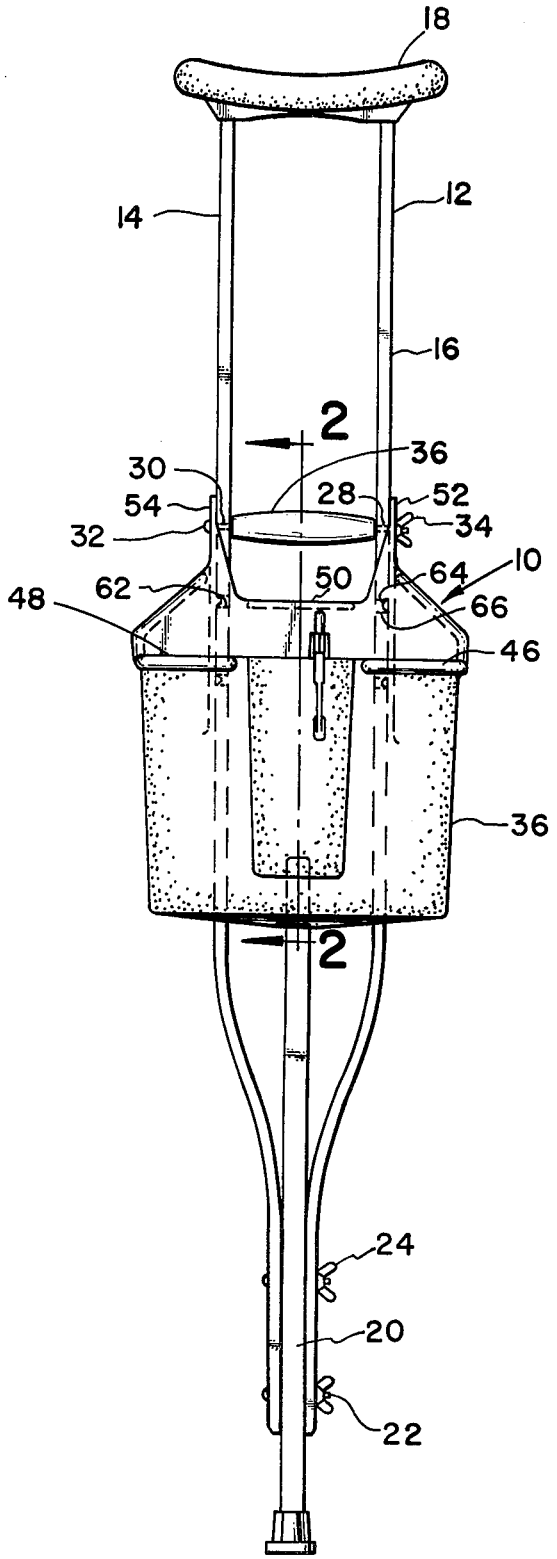
FIG. 1 is a front elevational view of a preferred container mounted on a crutch.

Referring to the drawings, a preferred crutch container 10 is mounted on a conventional crutch 12.

Crutch 12 has a pair of vertical side rails 14 and 16. A padded support 18 for engaging the arm pit of the user is mounted at the upper end of the two side rails. A leg 20 is connected by fastener means 22 and 24 between the lower ends of side rails 14 and 16 which converge toward leg 20. Each of the side rails has a plurality of opposed, aligned openings 26. Openings 26 include an upper pair 28 and 30. An elongated fastener 32 is mounted in openings 28 and 30, and a wing nut 34 locks the fastener into position. Fastener 32 passes through the handle to connect it to the side rails. Openings 26 in the side rails provide means for adjusting the height of the handle on the crutch.

Container 10 preferably comprises a one-piece plastic member having a backwall 38, a front wall 40, and a bottom wall 42 supported between walls 38 and 40. Bottom wall 42 has a drain hole 44 at its extreme bottom.

The container also has bead means 46, 48, and 50, formed around the open top to provide structural stiffness and for safety. A pair of elongated tabs 52 and 54 are connected to wall 38. The tabs are identical and spaced to accommodate the distance between side rails 14 and 16. The upper end of each tab has an opening 56 for receiving fastener 32. Thus the tabs provide means for connecting the container to the side rails, tab 54 being clamped between the head of fastener 32 and side rail 14, and tab 52 being clamped between side rail 16 and wing nut 34.

Figure 4:
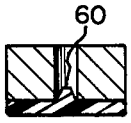
FIG. 4 is a view taken along lines 4—4 of FIG. 2.

Referring to FIG. 4, tab 54 has an integral tooth 60 received in opening 62. Tab 52 has a tooth 64 received in opening 66. Openings 62 and 66 are aligned and provide means for receiving fastener 32, depending upon the adjusted height of the handle on the crutch. Teeth 60 and 64 snap into their respective openings to provide means for securing the container to the crutch to prevent its lower end from moving with respect to the side rails.

Figure 3:
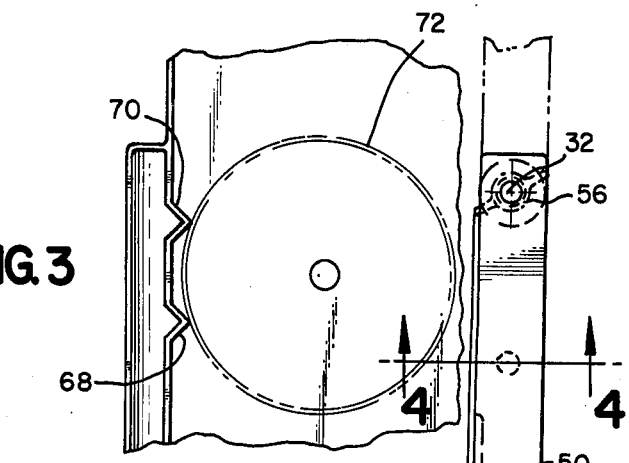
FIG. 3 is an enlarged view taken along lines 3—3 of FIG. 2.
Figure 2:
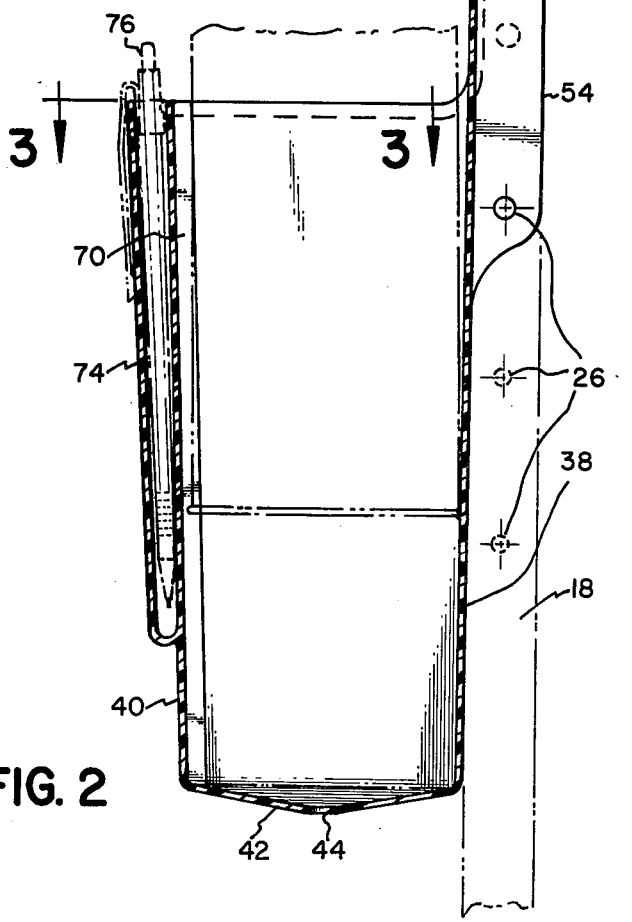
FIG. 2 is an enlarged fragmentary view as seen along lines 2—2 of FIG. 1.

Referring to FIGS. 2 and 3, a pair of elongated ridges 68 and 70 are carried on the inside surface of front wall 40. The two ridges are spaced with respect to the rear wall 38, a distance accomodating a standard cylindrical beverage can 72, to releasably clamp the beverage can between the two walls. The arrangement is such that can 72 is supported in a vertical position but allows the user to quickly remove the can from the container while providing means for securely supporting the can as the user is manipulating the crutches.

It is to be noted that the width of the container provides sufficient space for a large legal document and the like.

A pocket 74 is carried on front wall 40 and provides means for receiving writing instrument 72 and the like.

Figure 5:
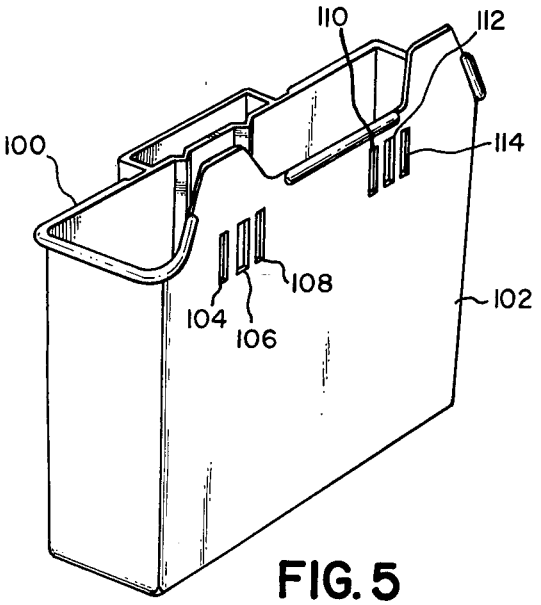
FIG. 5 is a view of another embodiment of the invention.
Figure 6:
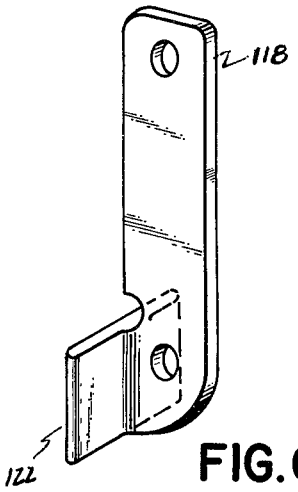
FIG. 6 illustrates a removable tab receivable in one of the slots of FIG,. 5.
Figure 7:
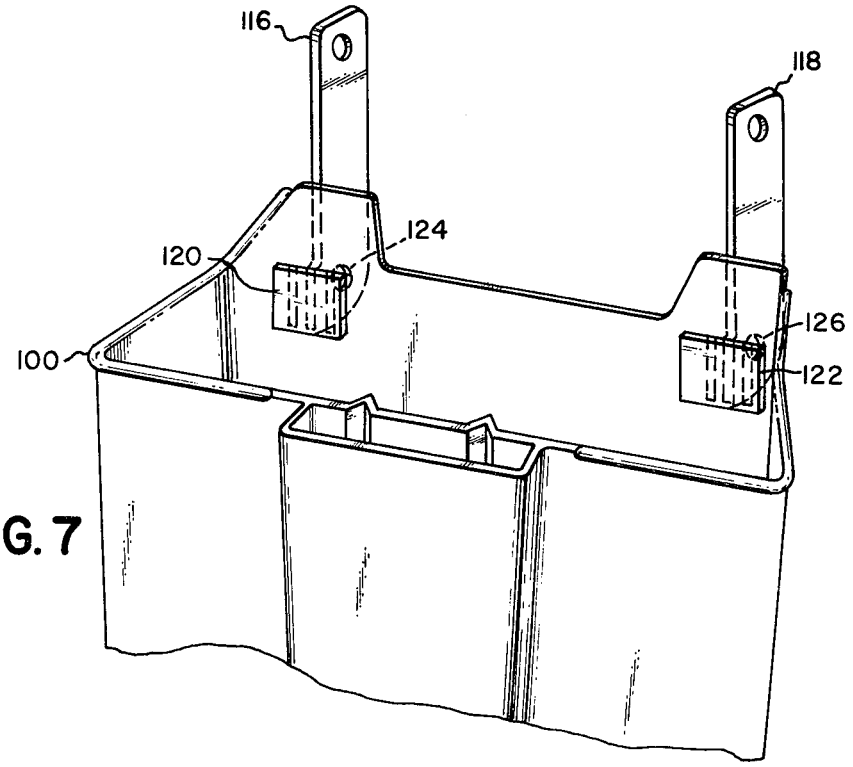
FIG. 7 is a perspective view illustrating the manner in which the removable tabs are mounted on the container.

FIGS. 5–7 illustrate another container 100 which is similar to container 10. Container 100 has a backwall 102 formed with a series of horizontally spaced slots 104, 106, 108, 110, 112, and 114. Tabs 116 and 118 are receivable in the slots. Tab 116 has a base 120 and tab 118 has a base 122. The two bases are engageable with the inside surface of backwall 102 as shown in FIG. 7.

The slots are spaced to accommodate the distance between the side rails of conventional crutches. For example, to connect the container to an infant's (not shown) the tabs are received in slots 108 and 110. To accommodate a crutch for children, the user mounts the tabs in slots 106 and 112. For an adult crutch, the user mounts the tabs in slots 104 and 114.

Tabs 116 and 118 are connected to the bolt or fastener which supports the crutch handle in the same manner as the embodiment of FIG. 1.

Tab 116 has an opening 124 and tab 118 has an opening 126 for receiving a second fastener (not shown) for connecting the tabs to a lower pre-existing opening in the crutch side rails in order to stabilize the container on the crutch.

Figure 8:
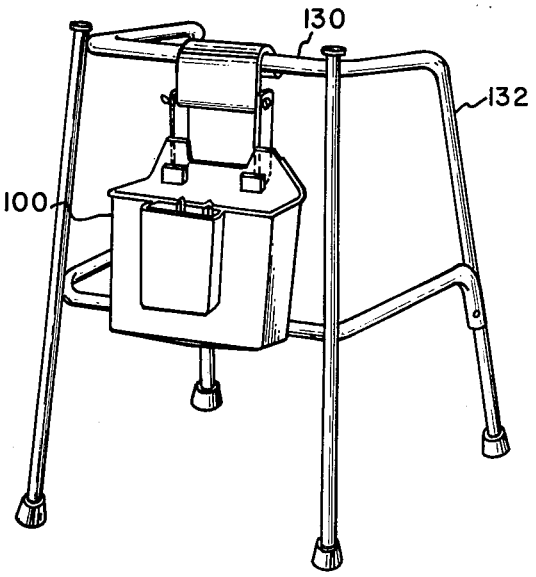
FIG. 8 is a view illustrating the manner in which the preferred container is mounted on an invalid walker.
Figure 9:
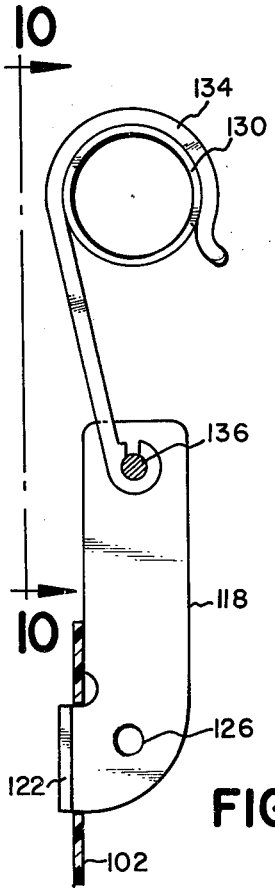
FIG. 9 is an enlarged fragmentary view showing the manner in which the retainer suspends the container from the invalid walker.
Figure 10:
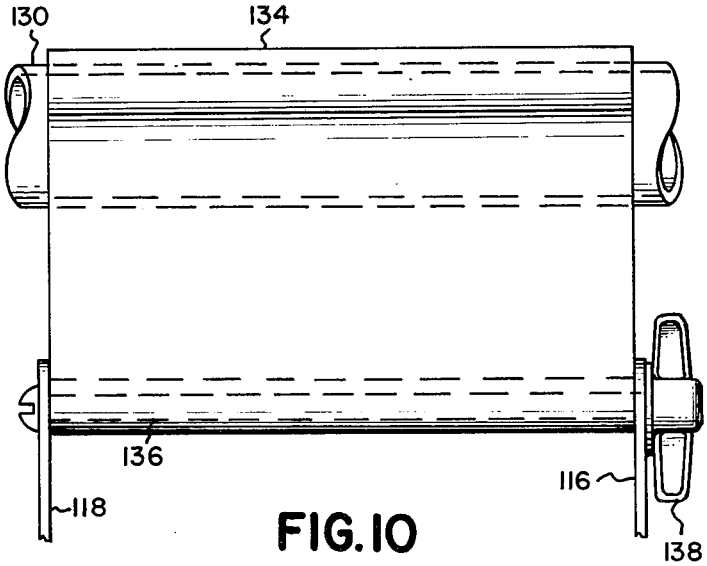
FIG. 10 is a view taken along lines 10—10 of FIG. 9.

FIGS. 8–10 illustrate container 100 suspended from the top horizontal rail 130 of a conventional invalid walker 132. In this embodiment of the invention, tabs 116 and 118 are supported by an elongated hook-shaped retainer 132 to rail 130, as illustrated in FIGS. 9 and 10. A bolt 136 and wing nut 138 fasten the tabs to opposite ends of the retainer. The hook-shaped configuration of the retainer permits the user to easily separate the container from rail 130.

Thus it can be seen that I have described in detail an easily manufactured high impact resistant plastic container that can be quickly attached to a conventional crutch on a fastener that supports the crutch handle. The container is securely fastened to the crutch without forming any additional holes in the crutch components. The container can also be readily mounted on an invalid walker.

Having described my invention, I claim:

1. For use with a crutch having a pair of spaced side rails, a handle disposed between said side rails at right angles thereto, elongated fastener means passing through said handle and having its ends supported on said side rails, a container comprising:

compartment means having an open top and a wall; and a pair of tabs connected to said wall, said tabs being spaced a distance accommodating the distance between the side rails so as to be disposed adjacent thereto, said tabs having aligned openings for receiving the fastener means such that the compartment means depends from said fastener means; and in which the side rails have a first pair of aligned openings receiving the fastener means, and a second pair of openings suited for receiving the fastener means to adjust the position of the handle on the side rails, and including tooth means integrally carried on the tabs and receivable in the second pair of openings to cooperate with the fastener means in preventing motion of the container with respect to the crutch side rails.

2. For use with a crutch having a pair of spaced side rails, a handle disposed between said side rails at right angles thereto, elongated fastener means passing through said handle and having its ends supported on said side rails, a container comprising:

compartment means having an open top and a wall;

a pair of tabs connected to said wall, said tabs being spaced a distance accomodating the distance between the side rails so as to be disposed adjacent thereto, said tabs having aligned openings for receiving the fastener means such that the compartment means depends from said fastener means; and including a cylindrically-shaped second container receivable through the open top of the first-mentioned container, elongated ridge means carried in the first-mentioned container for engaging the cylindrical-shaped container to prevent motion thereof with respect to said wall means.

3. For use with a crutch having a pair of spaced side rails, a handle disposed between said side rails at right angles thereto, elongated fastener means passing through said handle and having its ends supported on said side rails, a container comprising:

compartment means having an open top and a wall;

a pair of tabs connected to said wall, said tabs being spaced a distance accomodating the distance between the side rails so as to be disposed adjacent thereto, said tabs having aligned openings for receiving the fastener means such that the compartment means depends from said fastener means; and including a second wall spaced with respect to said first wall, and a pair of ridges mounted on the second wall to receive a beverage can between said ridges and the first-mentioned wall.

4. For use with a crutch having a pair of spaced side rails, a handle disposed between said side rails at right angles thereto, elongated fastener means passing through said handle and having its ends supported on said side rails, a container comprising:

compartment means having an open top and a wall;

a pair of tabs connected to said wall, said tabs being spaced a distance accommodating the distance between the side rails so as to be disposed adjacent thereto, said tabs having aligned openings for receiving the fastener means such that the compartment means depends from said fastener means; and in which the container wall has a plurality of spaced openings, and said tabs are removable received in a selected pair of said openings to accomodate the distance between the crutch side rails.

5. Container means as defined in claim 4, in which said tabs are spaced such that the side rails may be disposed between the tabs and in contact therewith.

6. A container as defined in claim 4, in which the container comprises a thin wall high impact resistant plastic member and including integral bead means carried about the edge defining said open top.

7. A container as defined in claim 4, in which said container has a bottom wall having a drainage opening.

* * * * *